United States Patent [19]

Oda

[11] 4,344,692

[45] Aug. 17, 1982

[54] DEVELOPER TRANSPORTATION DEVICE FOR ELECTROSTATIC COPYING MACHINE

[75] Inventor: Goro Oda, Tokyo, Japan

[73] Assignee: Tokyo Shibaura Denki Kabushiki Kaisha, Kawasaki, Japan

[21] Appl. No.: 129,728

[22] Filed: Mar. 12, 1980

[30] Foreign Application Priority Data

Mar. 15, 1979 [JP] Japan ..... 54-32359[U]
Mar. 15, 1979 [JP] Japan ..... 54-32360[U]

[51] Int. Cl.³ ..... G03G 15/08

[52] U.S. Cl. ..... 355/3 DD; 118/656; 118/661; 366/327; 366/329

[58] Field of Search ..... 355/3 R, 3 DD; 118/653, 118/656, 657, 658, 661; 366/195, 196, 325, 326, 327, 329, 330

[56] References Cited

U.S. PATENT DOCUMENTS 2,017,116 10/1935 Bonnell ..... 366/327
3,145,122 8/1964 Streich ..... 118/658
3,734,469 5/1973 Goldstein et al. ..... 366/327
3,764,208 10/1973 Takahashi et al. ..... 355/3 DD
3,895,958 7/1975 Gill et al. ..... 366/326 X
3,926,517 12/1975 Nagahara ..... 355/3 DD
4,026,241 5/1977 Takebe et al. ..... 355/3 DD X
4,112,870 9/1978 Extra et al. ..... 118/657 X

*Primary Examiner*—Fred L. Braun
*Attorney, Agent, or Firm*—Schuyler, Banner, Birch, McKie & Beckett

[57] ABSTRACT

A developer transportation device for transporting and evenly distributing developer for use in electrostatic copying machines, which has a rotary shaft, a first blade provided on the rotary shaft for transporting the developer in a first direction, a second blade provided on the same rotary shaft for transporting the developer in a second direction contrary to the first direction and a driving unit for driving the rotary shaft. The rotary action of the first and second blades causes the developer to be transported, agitated and evenly distributed by being moved in diverse directions.

9 Claims, 5 Drawing Figures

DEVELOPER TRANSPORTATION DEVICE FOR ELECTROSTATIC COPYING MACHINE

BACKGROUND OF THE INVENTION

This invention relates to generally an electrostatic copying machine, and more particularly to a developer transportation device for promptly uniformly supplying developer to a developing roller.

In recent years, an electrostatic copying machine has been developed comprising a longitudinally oriented transportation device and a developer supply container positioned at one side end of the developer transportation device. Such a developer transportation device has been widely used in the electrostatic copying field. Having the supply container at one side end of the developer transportation device permits the container to be easily accessible for replenishing developer. As a result, it is unnecessary to remove the developer transportation device from the main body of the copying machine when refilling the container. Rather, the supply container alone can be removed by pulling it out from engagement with the main body.

A developer transportation device having such a structure is shown in U.S. Pat. No. 3,764,208 (Takahasi et al). The developer transportation means disclosed in this patent (see FIG. 12) comprises a pair of parallel screw rollers adapted for moving the developer in diverse directions to provide a uniform level of developer within the body of the transportation means. In addition to utilizing a pair of rollers, further structure is required for moving the developer in diverse directions. In particular, a plurality of gears are employed for turning one roller in a first angular direction while turning the other roller in a second angular direction opposite to the first angular direction. Consequently, this prior art developer transportation device has the disadvantage of requiring many additional elements for its operation and, thereby, producing a complicated structure for transporting the developer.

SUMMARY OF THE INVENTION

It is an object of the present invention to provide a developer transportation device overcoming the disadvantages of the prior art by utilizing a simpler structure.

It is a further object of the present invention to provide a simple developer transportation device wherein the developer can be supplied from one side end of the device.

A still further object of the invention is to provide an electrostatic copying machine which the supplied developer is transported promptly and uniformly.

A still further object of the invention is to provide copies having sharp image and constant image density.

DETAILED DESCRIPTION OF THE PREFERRED EMBODIMENT

Referring now to FIGS. 1–5, an explanation will be given regarding the preferred embodiment of the invention.

Figure 1:
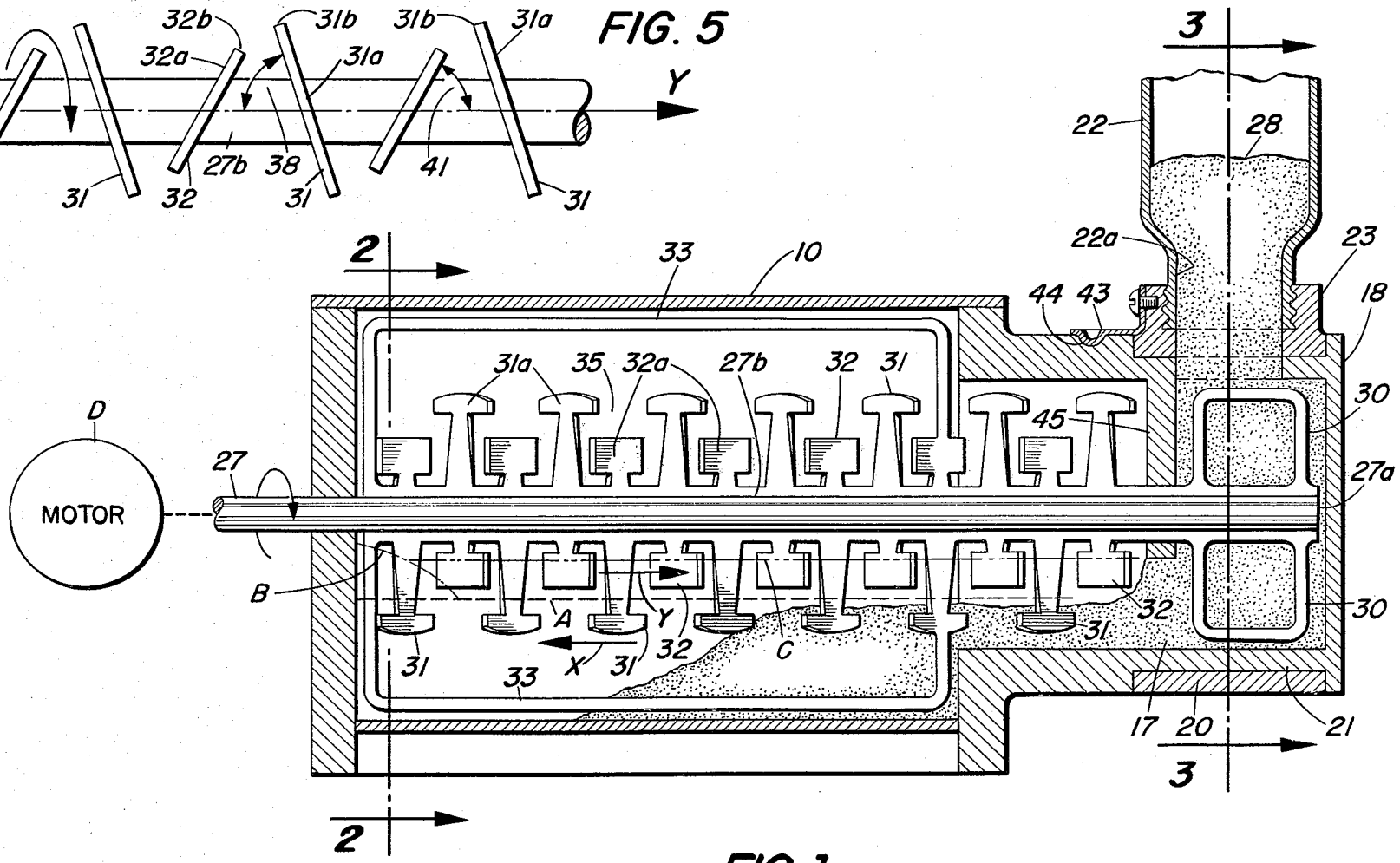
FIG. 1 is a longitudinal sectional view of the preferred embodiment of the invention.
Figure 2:
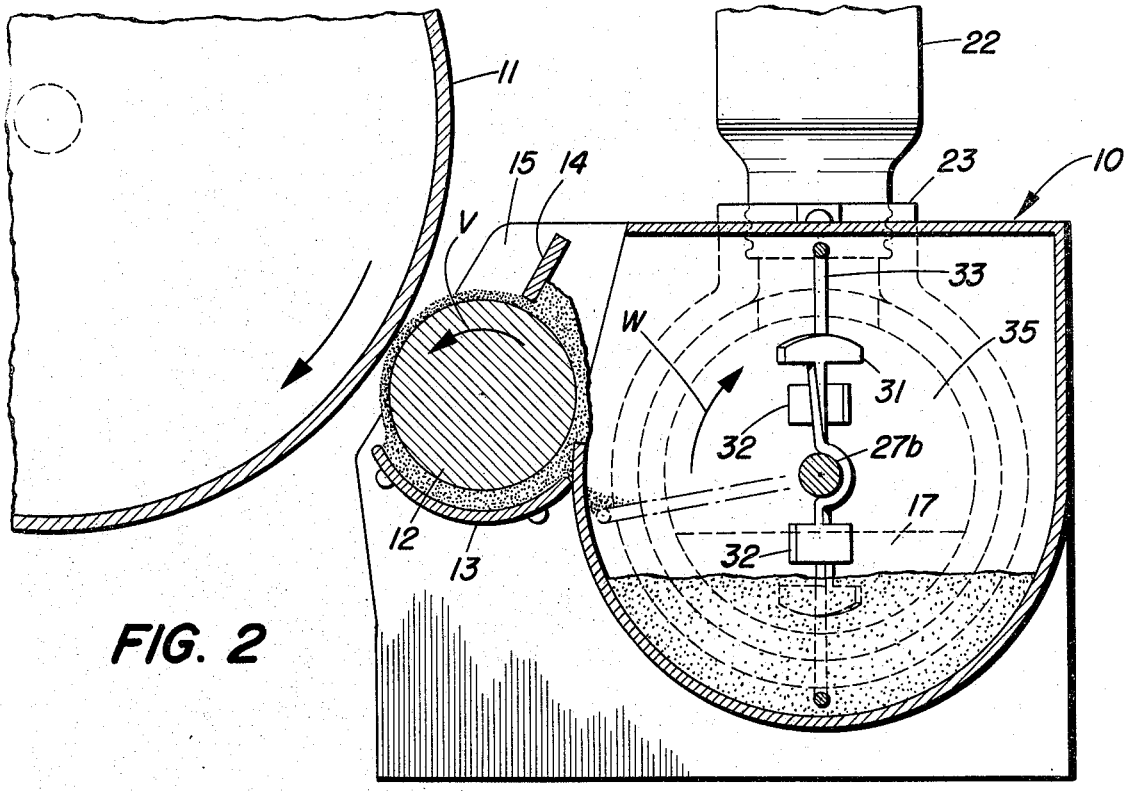
FIG. 2 is a transverse sectional view of along the line 2—2 of FIG. 1.

As shown in FIGS. 1–2, the electrostatic copying machine of the invention comprises a removable developer supply container 22, a developer supply chamber 18, a developer transportation unit 35, contained within a casing 10, developer transfer station 15, and an electrophotographically sensitive drum 11. Developer 28, contained within supply container 22, is supplied to chamber 18 where it is transported into casing 10 by the transportation unit 35. Transfer rod 33, operatively connected to the transportation unit 35, transfers the developer within casing 10 to developing magnetic roller 12, contained within developer transfer station 15. The developer is finally transported from roller 12 onto the electrophotographically sensitive drum 11 for forming a visible powder image.

Figure 3:
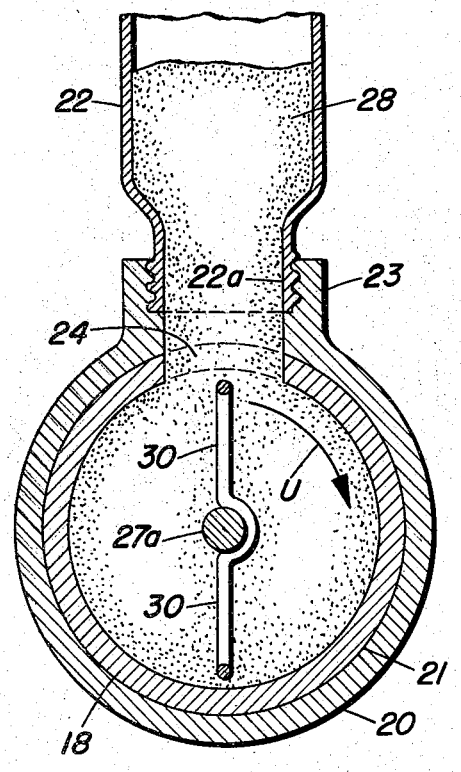
FIG. 3 is a sectional view taken on line 3—3 of FIG. 1 showing the developer container in a vertical position to feed into the supply chamber.
Figure 4:
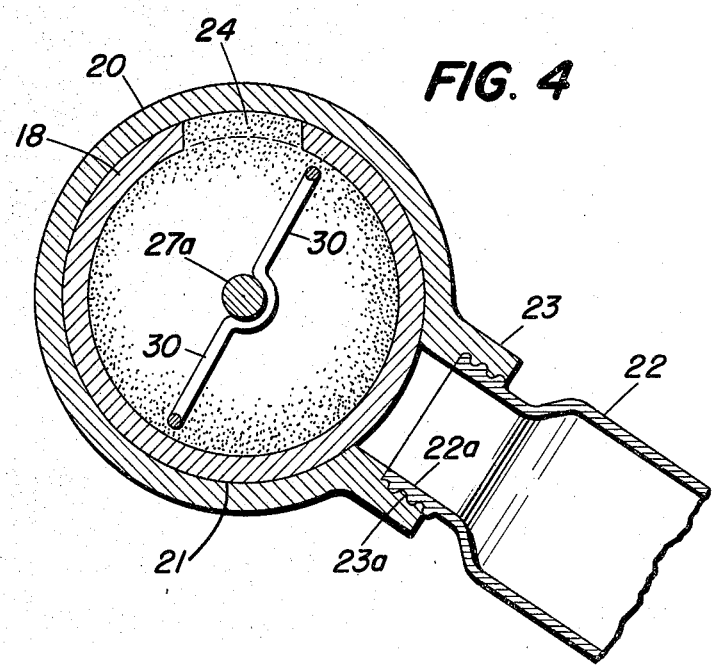
FIG. 4 is similar to FIG. 3, but with the empty developer container rotated downwardly so that it can be replaced with a full container.

The developer supply container 22 is removably attachable by screw threads to a cylinder 20. As known in the prior art, the cylinder 20 is rotatably coupled with a peripheral wall 21 of the developer supply chamber 18 (see, e.g., U.S. Pat. No. 3,764,208). As shown in FIGS. 3–4, cylinder 20 is provided with a threaded opening 23 which receives a threaded opening **22*a* of developer supply container 22. The upper part of peripheral wall 21 includes a supply inlet 24 having substantially the same diameter as the inner diameter of threaded opening 23**.

A separating wall 45 separates the developer supply chamber 18 from the transportation unit 35. As shown in FIGS. 1–2, however, the lower portion of wall 45 contains an orifice 17 which is semicircular in shape and is aligned with the lower portion of peripheral wall 21. Orifice 17 permits developer to be supplied from the supply chamber 18 to within casing 10 of transportation unit 35. As shown in FIG. 1, a rotary shaft 27 extends from a driving device D through casing 10 and into developer supply chamber 18. Positioned on a portion **27*a* of rotary shaft 27 within developer supply chamber 18, are a pair of rod-like agitator elements 30. When driving device D is energized (e.g., approximately 50 R.P.M.), the agitator elements 30 stir the developer 28 supplied from the container 22 and promote its discharge through discharge orifice 17 and into casing 10. Positioned on a portion 27*b* of rotary shaft 27 within casing 10, are a plurality of first blades 31 and a plurality of second blades 32 to form the developer transportation unit 35. As shown in FIG. 1, a first set of the first and second blades are alternately positioned and aligned along the axis of the upper portion of shaft 27*b*, while a second set of first and second blades are alternately positioned and aligned along the axis of the lower portion of shaft 27*b*. As a result, the first and second set of blades will be positioned diametrically opposite for each angular movement of shaft 27 during rotation. Although the first and second blades of the first set are shown in FIG. 1 to by asymmetrically positioned about the axis of shaft 27*b*, with respect to the first and second blades of the second set, it is also contemplated by the invention that the blades can be symmetrically positioned about the axis of shaft 27*b***.

A pair of transfer rods 33 are provided on rotary shaft 27*b* for transferring the developer 28 within casing 10 to magnetic roller 12 of developer transfer station 15. Transfer rods 33 have, for example, a diameter of 3 mm and are rotated at approximately 50 R.P.M. with first and second blades 31, 32. Positioned beneath the lower portion of magnetic roller 12 is a developer holding frame 13 for catching any developer which has not adhered to magnetic roller 12. Developer transfer station 15 includes a leveler 14 for regulating the thickness of developer which adheres to magnetic roller 12.

Figure 5:
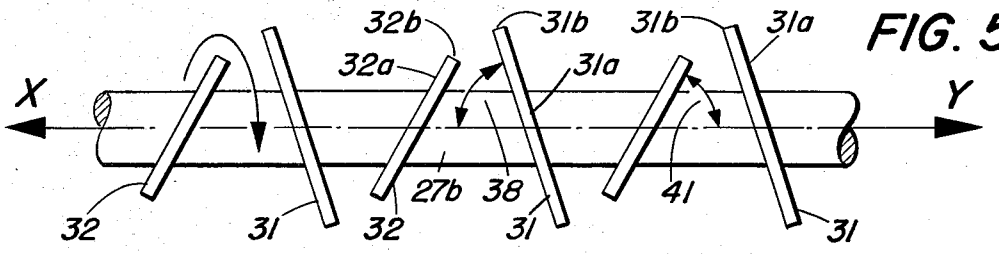
FIG. 5 is a partially plan view showing the positioning and orientation of the first and second blades.

As will be discussed below, first blades 31 transport the developer in a first direction x, while second blades 32 transport the developer in a second direction y which is contrary to the first direction (see FIGS. 1 and 5). As shown in FIG. 5, first blades 31 and second blades 32 are mounted to shaft 27*b* and when rotated in the direction indicated have trailing edges 31*b* and 32*b*, respectively. First blades 31 are mounted to the shaft so as to have its trailing edges 31*b* positioned at approximately an angle 38 to the first direction of transportation x. Second blades 32 are mounted to the shaft so as to have its trailing edge 32*b* positioned at approximately an angle 41 to the second direction of transportation y. The angle 38 of the first blades must be more than angle 41 of the second blades. For example, angle 38 could be 70° while angle 41 is 60°. As shown in FIGS. 1 and 5, first blades 31 and second blades 32 are formed to have a first surface area 31*a* and a second surface area 32*a*, respectively; second surface area 32*a* being larger than first surface area 31*a*.

As shown in FIG. 1, a leaf spring 43 connected to cylinder 20 provides temporary positional locking of cylinder 20 and supply chamber 18. A convex portion of leaf spring 43 is received within a recess 44, formed on the outer surface of the supply chamber 18, for maintaining cylinder 20 in a position such that opening 23 and supply inlet 24 coincide.

Next, explanation will be given regarding the operation of the developer transportation device. With the container 22 positioned in a vertical position as shown in FIG. 3, developer will be supplied into the supply chamber 18. When container 22 is empty, it can be replaced by rotating it downwardly in the u direction as shown in FIG. 4, so that it can be replaced with a full container 22. To permit such downward rotation of cylinder 20 and container 22, it is necessary to remove the convex portion of leaf spring 43 from recess 44. While in this downward position, the empty container can be unscrewed from threaded opening 23*a* and replaced with a full container. The threaded opening 22*a* of a full supply container 22 can be screwed into position with opening 23 of cylinder 20 and then rotated upwardly to the vertical position shown in FIG. 3. In this vertical position, the convex portion of the leaf spring 43 can then engage recess 44 and maintain cylinder 20 in position. When in this position, the opening 23 and the supply inlet 24 coincide and, thereby, permit developer 28 within supply chamber 22 to be supplied into chamber 18. Furthermore, a portion of the developer supplied to chamber 18 will discharge into casing 10 through orifice 17.

Upon energizing drive unit D, the magnetic roller 12 is rotated in the v direction and the rotary shaft 27 is rotated in the w direction. As a result, the developer 28 is transported through the casing 10 in the x direction by the rotary action of the first blades 31 through the developer. As the developer is moved in the x direction by the action of first blades 31, a space is temporarily produced adjacent orifice 17 which permits developer to be discharged from the supply chamber 18 into the casing 10 with the aid of the agitator 30. When the developer 28 reaches the level shown by broken line A, it is successively stacked at the opposite end of casing 10 as shown by broken line B. When this occurs, the developer is then transported in the y direction by the rotary action of the second blades through the developer. The action of blades 32 produce transportation of the developer in direction y contrary to direction x since the trailing edges 32*b* of blades 32 are angled in an opposite direction to first blades 31. The transport speed of the developer in the y direction is faster than in the x direction due to the angular orientation and surface area of blades 32. That is, angle 41 of second blades 32 is smaller than angle 38 of first blades 31, and the surface area 32*a* of second blades 32 is larger than the surface area 31*a* of first blades 31. Since blades 31 are spaced farther from shaft 27 than blades 32, blades 32 contact the developer at a depth or zone which represents a lesser distance from shaft 27 than the depth or zone that blades 31 contact the developer.

Due to the rotary action of both blades 31 and 32, the surface of the developer within casing 10 is made level and even; the height of this surface eventually reaches the height of the upper end of the developer discharging orifice 17, as shown by broken line C. As the developer within casing 10 is consumed during the photocopying process, developer from supply chamber 18 is supplied to casing 10. The amount of developer consumed during the photocopying process will equal to the amount of developer supplied from chamber 18. As a result, the developer 28 within casing 10 is held at the constant level shown by broken line C. Since the transport speed in the y direction is larger than that in the x direction, developer 28 is made even (see line C—FIG. 1) without being stacked (see line B—FIG. 1) at the opposite end of the casing 10.

I claim:

1. A developer transportation device for transporting and evenly distributing developer for use in electrostatic copying machines, which comprises:

(a) a substantially horizontal rotary shaft;

(b) a first blade means provided on said rotary shaft for contacting said developer at a first zone spaced from said shaft and transporting the developer horizontally through said first zone in a first direction substantially throughout the length of said shaft;

(c) a second blade means provided on said rotary shaft for contacting said developer at a second zone at a lesser distance from said shaft than said first zone and transporting the developer horizontally through said second zone, in a second direction contrary to said first direction substantially throughout the length of said shaft; and (d) a driving means for driving said rotary shaft, whereby said developer is transported, agitated and evenly distributed such that the developer is substantially leveled by being moved in diverse horizontal directions throughout said first and second zones by said first and second blade means.

2. The developer transportation device of claim 1 wherein said second blade means transports said developer at a higher rate of speed than said first blade means.

3. The developer transportation device of claim 2 wherein said first blade means comprises a plurality of first blades spaced along said shaft for rotation therewith, and said second blade means comprises a plurality of second blades spaced along said shaft for rotation therewith.

4. The developer transportation device of claim 3 wherein the trailing edges of said first blades being angled more in the first direction of transportation than the trailing edges of said second blades being angled in the second direction of transportation.

5. The developer transportation device of claims 3 or 4 wherein each of said first blades have a first surface area and each of said second blades have a second surface area which is larger than said first surface area.

6. In an electrostatic copying machine having an electrophotographically sensitive member, a developer supply container, a developer supply chamber for storing the developer supplied from the container and having an orifice for permitting the developer to be supplied from the chamber to within a casing, developer transportation means within the casing for transporting the developer from the container through the supply chamber and into the casing, and developer transfer means for transferring developer from the casing to the electrophotographically sensitive member, the improvement wherein said developer transportation means comprises:

(a) a substantially horizontal rotary shaft, (b) driving means for rotating said shaft, (c) first blade means mounted on said shaft for contacting said developer at a first zone spaced from said shaft and transporting the developer horizontally through said first zone in a first direction substantially throughout the length of said shaft, (d) second blade means mounted on said shaft for contacting said developer at a second zone at a lesser distance from said shaft than said first zone and transporting the developer horizontally through said second zone in a second direction contrary to said first direction substantially throughout the length of said shaft, whereby said developer is transported, agitated and evenly distributed such that it is substantially leveled by being moved in diverse horizontal directions throughout said first and second zones by said first and second blade means.

7. The electrostatic copying machine as claimed in claim 6 further comprising:

a stirring means positioned inside said supply chamber and provided on the rotary shaft for stirring the developer supplied from the container.

8. The electrostatic copying machine as claimed in claim 6 wherein said developer transfer means comprises:

a developer roller means for transferring the developer from the casing to the surface of the electrophotographically sensitive member.

9. The electrostatic copying machine as claimed in claim 8 wherein said developer transfer means further comprises:

a transfer rod means positioned on said rotary shaft for transferring the developer from said casing to said developer roller.

* * * * *